US006382156B1

(12) United States Patent
Fukuhara et al.

(10) Patent No.: US 6,382,156 B1
(45) Date of Patent: May 7, 2002

(54) VALVE TIMING CONTROL DEVICE

(75) Inventors: Katsuyuki Fukuhara, Hyogo; Hiroyuki Kinugawa, Tokyo, both of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/881,761

(22) Filed: Jun. 18, 2001

(30) Foreign Application Priority Data

Dec. 18, 2000 (JP) ..... 2000-384273

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 5,943,989 A * 8/1999 Kira ..... 123/90.17
6,105,543 A * 8/2000 Ogawa ..... 123/90.17
6,318,319 B1 * 11/2001 Miyasaka et al. ..... 123/90.17
6,330,870 B1 * 12/2001 Inoue et al. ..... 123/90.17

FOREIGN PATENT DOCUMENTS

JP 10-159519 6/1998
JP 10-159520 6/1998
JP 11-294120 10/1999

* cited by examiner

*Primary Examiner*—Weilun Lo
(74) *Attorney, Agent, or Firm*—Sughrue Mion, PLLC

(57) ABSTRACT

A valve timing control device has a hydraulic pressure supply passage for supplying a hydraulic pressure used for releasing lock due to the lock member. If a hydraulic pressure applied to the hydraulic pressure supply passage reaches a required pressure, a hydraulic pressure subjected to a major diameter section of the lock member is larger than the sum total of the biasing force of two biasing members. Thus, the lock member is returned in a direction of releasing the lock due to the lock member. The sliding member is moved backward while the lock member is also moved backward. The stroke of the sliding member is extremely shorter than that of the lock pin. With a locked state of leaving the engagement of a minor diameter section of the lock member with an engagement hole, a rear end face of a minor diameter section of the sliding member abuts with a rear wall face 16*c* of a backward pressure chamber. Thus, it is difficult that a backward pressure space defined between the lock member and the sliding member communicates with a discharge hole. Since the opening area of the discharge hole substantially is throttled, a speed of discharging the backward pressure is considerably delayed.

14 Claims, 6 Drawing Sheets

A STATE OF THROTTLING A DISCHARGE HOLE

DURING A RELEASE OPERATION
(A STATE OF THROTTLING A DISCHARGE HOLE IN A FIRST STEP)

LOCKED STATE

RELEASED STATE

LOCKED STATE (A STATE OF OPENING A DISCHARGE HOLE)

A STATE OF THROTTLING A DISCHARGE HOLE

RELEASED STATE

LOCKED STATE (A STATE OF OPENING A DISCHARGE HOLE)

DURING A RELEASE OPERATION
(A STATE OF THROTTLING A DISCHARGE HOLE IN A FIRST STEP)

RELEASED STATE
(A STATE OF THROTTLING A DISCHARGE HOLE IN A SECOND STEP)

LOCKED STATE (A STATE OF OPENING A DISCHARGE HOLE)

DURING A RELEASE OPERATION
(A STATE OF THROTTLING A DISCHARGE HOLE)

RELEASED STATE
(A STATE OF THROTTLING A DISCHARGE HOLE)

VALVE TIMING CONTROL DEVICE

BACKGROUND OF THE INVENTION

1. Field of the Invention

The present invention relates to a valve timing control device,for modifying the-opening and closing timing of the intake and exhaust valves in an internal-combustion engine (hereafter, ref erred as an engine) according to any operating condition.

2. Description of the Prior Art

Conventional valve timing control devices of various structures,are proposed as disclosed in JP-A-1998/159519, JP-A1998/159520 and JP-A-1999/294120, for example.

FIG. 1 is a lateral cross sectional view of an internal construction of the) conventional vane-type valve timing control device. FIG. 2 is a longitudinal cross sectional view taken along lines A-A of FIG. 1. FIG. 3A and FIG. 3B are enlarged cross sectional views of a lock member in the valve timing control device of FIG. 2, FIG. 3A showing a locked state, and FIG. 3B showing a released state. In the drawings, reference numeral 1 denotes a pulley which connects with, a crankshaft (not shown) of the engine through chains (not shown) to rotate in synchronization with the crankshaft (not shown). 2 denotes a housing fitted to the pulley 1 and having a bearing part 2*a* with respect to an intake or exhaust camshaft (hereafter, referred as a camshaft) 3. 4 denotes a case having a plurality of shoes 4*a*, the respective shoes 4*a* projecting from an inside of the case 4 to constitute a plurality of hydraulic pressure chambers defined between the shoes 4*a*. 5 denotes a cover of covering the hydraulic pressure chambers of the case 4. The housing 2, the case 4 and the cover 5 are connected, integrally to each other by a threaded member 6 such as a bolt and soon. Here, the pulley 1, the housing 2, the case 4 and the Cover 5 constitute a first, rotor.

A rotor (second rotor) 9 is fixed integrally to an one end 3*a* of the camshaft 3 by a threaded member 8 such as a bolt and so on through a washer 9. The rotor 7 is arranged rotatably in the first rotor. A plurality of vanes 7*a* are arranged at an outer circumferential portion of the rotor 7, dividing the hydraulic pressure chambers into an advance side hydraulic pressure chamber 10 and a retardation side hydraulic pressure chamber 11. A first oil passage 12 and a second oil passage 13 are arranged in the camshaft 3. The first oil passage 12 supplies hydraulic pressure to and discharges hydraulic pressure from the advance side hydraulic pressure chamber 10, and the second oil passage 13 supplies hydraulic pressure to and discharges hydraulic pressure from the retardation side hydraulic pressure chamber 11. Moreover, seal means 14 are arranged on both of front ends of the shoes 4*a* of the case 4 and the vanes 7*a* of the rotor 7, respectively. The respective seal means 14 prevent leakage of oil between the both of the hydraulic pressure chamber 10 and 11. The seal means 14 includes a seal member 14*a* of sliding on an inner wall face of the hydraulic pressure chamber 10 or 11 and a plate spring 14*b* of biasing the seal member 14*a* toward the inner wall face.

A lock pin 15 having a cylindrical shape is arranged at the housing 2 constituting the first rotor above and restricts relative rotation of the first rotor and the second rotor. Since hydraulic pressure in the valve timing control device is reduced on starting the engine, the rotor 7 acting as the second rotor vibrates in the rotational direction by a cam load applied to a cam (not shown) integrated with the camshaft 3. In this way, since the first and second rotors undergo repetitive contact and separation as a result of the vibration, beat noise (abnormal noise) necessarily results. The lock pin 15 prevents the occurrence of beat noise (abnormal noise). Therefore, the lock pin 15 is biased by a biasing member 17 such as a coil spring toward the second rotor and thus allows the engagement with an engagement hole will be explained hereafter. The biasing member 17 is arranged between a rear wall of a backward pressure chamber 16 and the lock pin 15. A discharge hole 18, which discharges a backward pressure of the lock pin 15, is formed in the backward pressure chamber 16.

On the other hand, an engagement hole 19, which allows insertion of the lock pin 15, is formed at the vane 7*a* of the rotor 7 acting as the second rotor The engagement hole 19 communicates with a valve 21 through a hydraulic pressure supply passage 20 of supplying a release hydraulic pressure for releasing engagement (hereafter, referred as lock) of the lock pin 15. The valve 21 communicates with both the advance side hydraulic pressure chamber 10 and the retardation side hydraulic pressure chamber 11, and is a member for selecting the higher hydraulic pressure from the above chambers in order to supply the selected pressure to the hydraulic pressure supply passage 20.

Next, a release operation will be explain.

In a release operation, hydraulic pressure is supplied from an oil pump (not shown) to the engagement hole 19 through the advance side hydraulic pressure chamber 10 or the retardation side hydraulic pressure chamber 11, the valve 21 and the hydraulic pressure supply passage 20. In this way, the hydraulic pressure presses the lock pin 15 against the biasing force of the biasing member 17 to move the lock pin 15 back in the backward pressure chamber 16. Here, backward pressure of the lock pin 15 is discharged from the discharge hole 18 to the outside of the valve timing control device. Since an area (an area determined by a diameter D of the lock pin 15 as shown in FIG. 3A) subjected to hydraulic pressure is constant from a locked state of the lock pin 15 to the end of a released state, discharge of the backward pressure is also constant. When a front end of the lock pin 15 is released from the engagement hole 19 and is accommodated in the backward pressure chamber 16, the lock of the lock pin 15 is released to allow free rotation between the first and second rotors.

It is noted that when the engine is stopped, oil in the advance side hydraulic pressure chamber 10 and the retardation side hydraulic pressure chamber 11 moves downwardly to an oil-pan (not shown) through the first and second oil passages 12 and 13 and so on. Therefore, air accumulates in pipe arrangement such as the respective hydraulic pressure chambers and the respective oil passages. In this state, when the engine is restarted, a hydraulic pressure rises by the oil pump (not shown) and simultaneously air accumulated in the pipe arrangement is discharged at once. Thus, the air-mixing oil is applied in the valve timing control device to release instantly the lock pin 15 from the engagement hole 19.

However, the following problems result from the above structure for a conventional valve timing control device.

When the air-mixing oil releases the lock on starting the engine, the hydraulic pressure in the advance side hydraulic pressure chamber 10 and the retardation side hydraulic pressure chamber 11 cannot absorb the cam load described above because of air mixing oil. Since the first and second rotors repeat contact and separation therebetween, beat noise (abnormal noise) necessarily results.

SUMMARY OF THE INVENTION

Accordingly, it is an object of the present invention to provide a valve timing control device, which prevents the occurrence of beat noise (abnormal noise) in a release operation resulting from the air-mixing oil on starting the engine.

In order to achieve the object of the present invention, a valve timing control device comprises a first rotor rotating in synchronization with a crankshaft of an internal combustion engine; a second rotor fixed on an end of an intake camshaft or an exhaust camshaft of the internal combustion engine and rotatably arranged in the first rotor; a lock member locking the first and second rotors at a required angle which any one of the rotors forms with the other; a backward pressure chamber arranged at any one of the first and second rotors, the backward pressure chamber allowing accommodation of the lock member and a biasing member biasing the lock member and having a discharge hole for discharging the backward of the lock member to the outside; an engagement hole arranged at the other rotor, the engagement hole allowing insertion of the lock member and having a hydraulic pressure supply passage for supplying a hydraulic pressure used for releasing lock due to the lock member and a variable throttle mechanism arranged in the backward pressure chamber, the variable throttle mechanism throttling an opening area of the discharge hole in the backward pressure chamber on releasing the lock due to the lock member and controlling the opening area of the discharge hole at the maximum on locking due to the lock member. In this way, since the opening area of the discharge hole can be throttled on releasing the lock due to the lock member, a discharge speed of the backward pressure can delay considerably as compared with the conventional device. Thus, a backward speed of the lock member and a speed of releasing the lock can be also delayed. Moreover, with a state of rising a hydraulic pressure on starting the engine, a release operation due to the lock member cannot be performed promptly. After the hydraulic pressure sufficient to control the valve timing control device is applied thereto, the lock member can be released and thus can prevent beat noise (abnormal noise) which occurs in the conventional example. Since a closing of the discharge hole due to the variable throttle mechanism can be released on locking the lock due to the lock member, the engagement due to the lock member can be performed at the same speed as the conventional device.

The variable throttle mechanism may include a sliding member having a perforation hole formed inside thereof, the sliding member closing the discharge hole on releasing the lock due to the lock member and opening the discharge hole on locking due to the lock member. In this way, since the sliding member can be slid in response to the sliding motion of the lock member, the discharge hole can be closed on releasing the lock due to the lock member and can be opened on locking due to the lock member.

The sliding member may slide in parallel with the sliding axis of the lock member to close the discharge hole on releasing the lock due to the lock member and may slide in parallel with the sliding axis of the lock member to open the discharge hole on locking due to the lock member. In this way, since the sliding member can be slid in response to the sliding motion of the lock member, the discharge hole can be closed on releasing the lock due to the lock member and can be opened on locking due to the lock member.

The variable throttle mechanism may close the discharge hole continuously and variably. In this way, since the opening area of the discharge hole on releasing the lock due to the lock member can be throttled continuously and variably, a releasing speed can be changed continuously.

The variable throttle mechanism may have a biasing member for biasing the sliding member in a direction of opening the discharge hole on locking the lock due to the lock member. In this way, since the sliding member, which throttles the opening area of the discharge hole on locking due to the lock member until now, can be slid in a direction of controlling the opening area of the discharge hole at the maximum, the engagement due to the lock member can be performed at the same speed as the conventional device.

The variable throttle mechanism may include a throttle rod integrated with the lock member, the throttle rod closing the discharge hole on releasing the lock due to the lock member and opening the discharge hole on locking due to the lock member. In this way, with the device, the discharge hole can be closed on releasing the lock due to the lock member and can be opened on locking. Moreover, since the number of parts of the device can be reduced, it is possible to reduce manufacturing costs and facilitate assembly.

The throttle rod may slide coaxially on the sliding axis of the lock member to close the discharge hole on releasing the lock due to the lock member and may slide coaxially on the sliding axis of the lock member to open the discharge hole on locking due to the lock member. In this way, the discharge hole can be closed effectively on releasing the lock due to the lock member and opened effectively on locking.

The variable throttle mechanism may close the discharge hole in a stepwise manner. In this way, the opening area of the discharge hole can be throttled in a stepwise manner on releasing the lock due to the lock member, the releasing speed can be changed in a stepwise manner.

BRIEF DESCRIPTION OF THE DRAWINGS

FIG. 3A and FIG. 3B are enlarged cross sectional views of a lock member in the valve timing control device as shown in FIG. 2, wherein FIG. 3A shows a locked state, and FIG. 3B shows a released state.

DESCRIPTION OF THE PREFERRED EMBODIMENT OF THE INVENTION

Hereafter, one embodiment according to the present invention will be explained. Moreover, with the explanation of each embodiment, a lock member is arranged at a first rotor, and an engagement hole engaged with the lock member is arranged at a second rotor in accordance with the conventional example as shown in FIG. 1 to FIG. 3C. However, the present invention is not limited to such construction, and may be a reverse construction that the lock member is arranged at the second rotor, and that the engagement hole is arranged at the first rotor.

Embodiment 1

Figure 1:
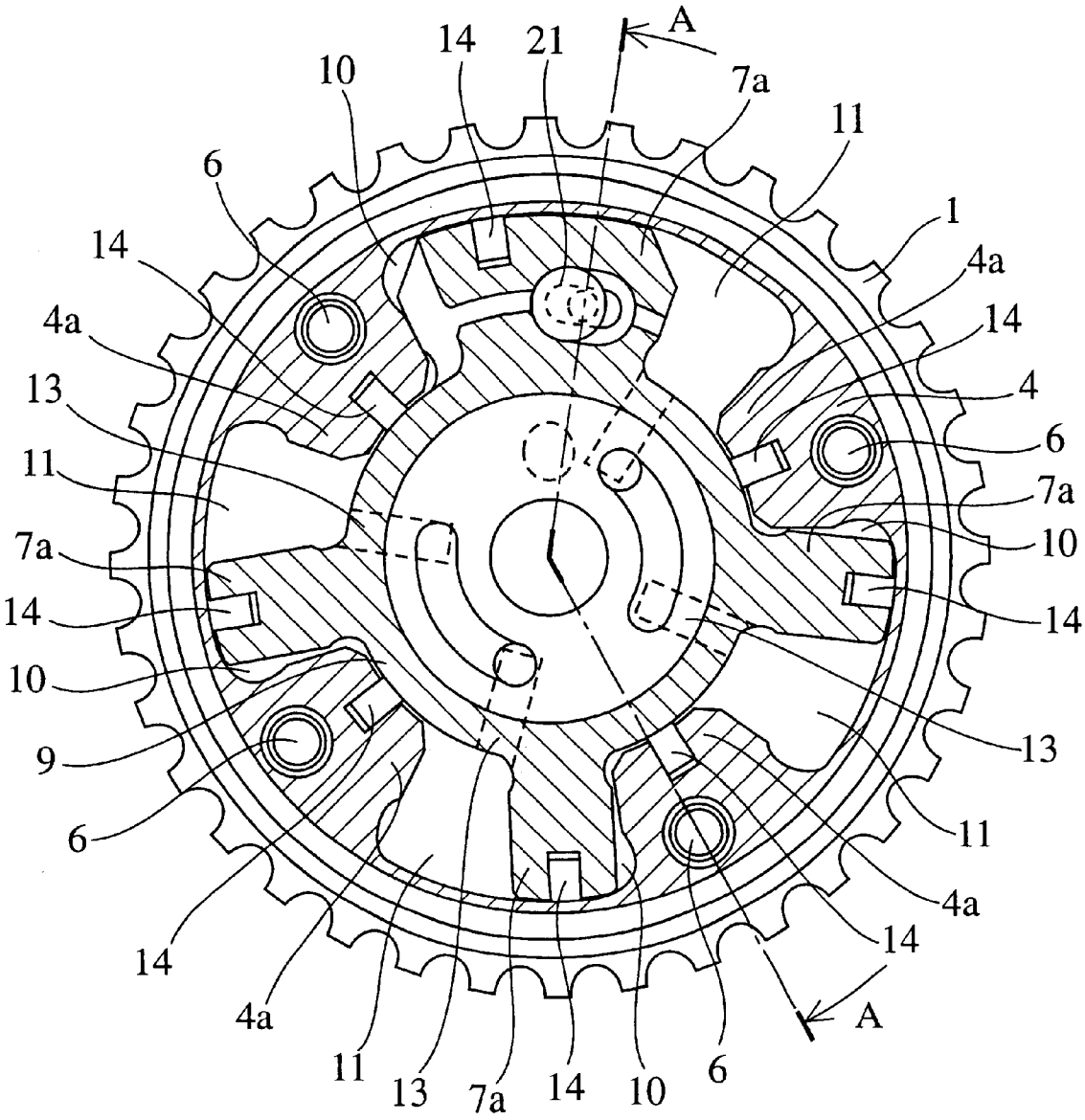
FIG.1 (PRIOR ART)
FIG. 1 is a lateral cross sectional view of an internal construction of the conventional vane-type valve timing control device.
Figure 2:
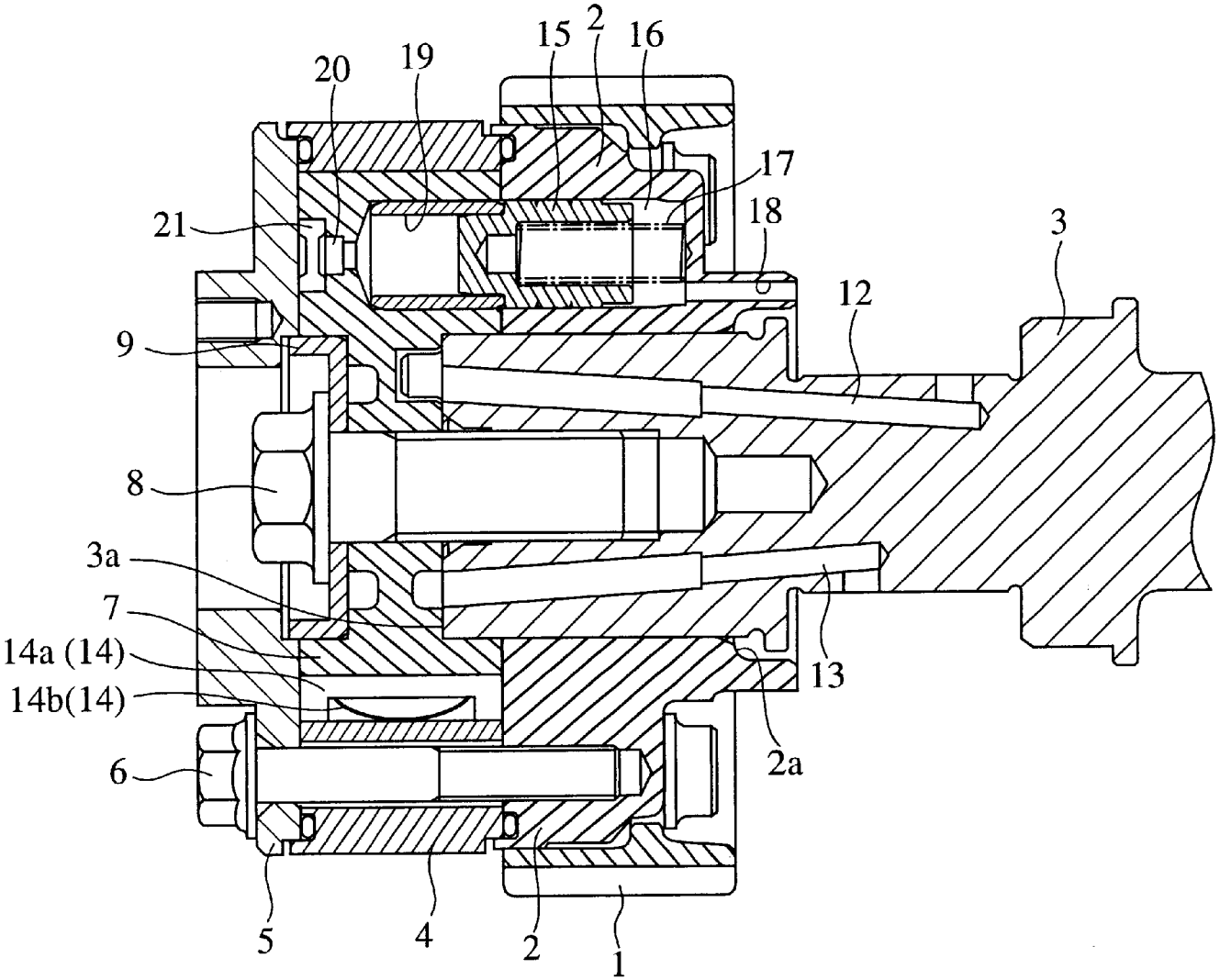
FIG.2 (PRIOR ART)
FIG. 2 is a longitudinal cross sectional view taken along lines A—A of FIG. 1.
Figure 3A:
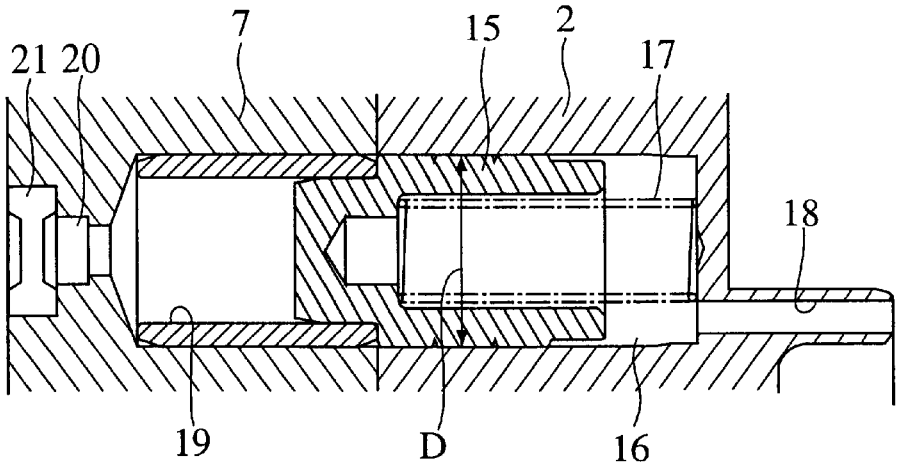
FIG.3A (PRIOR ART)
Figure 3B:
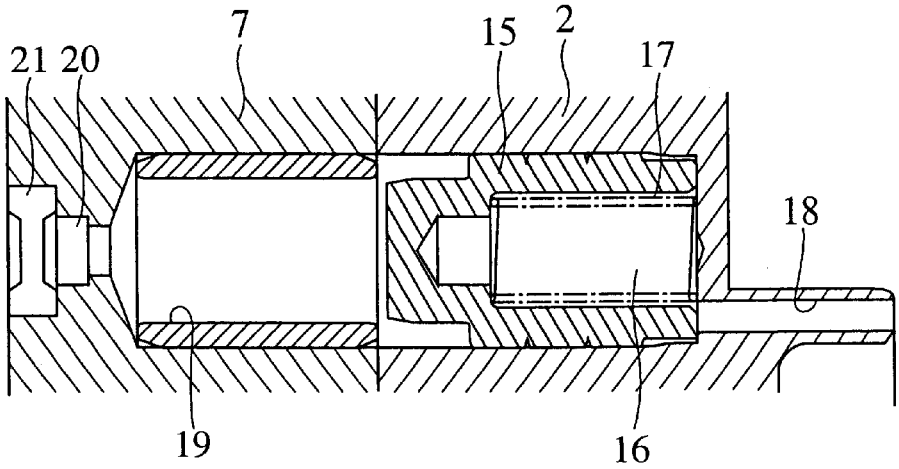
FIG.3B (PRIOR ART)
Figure 4A:
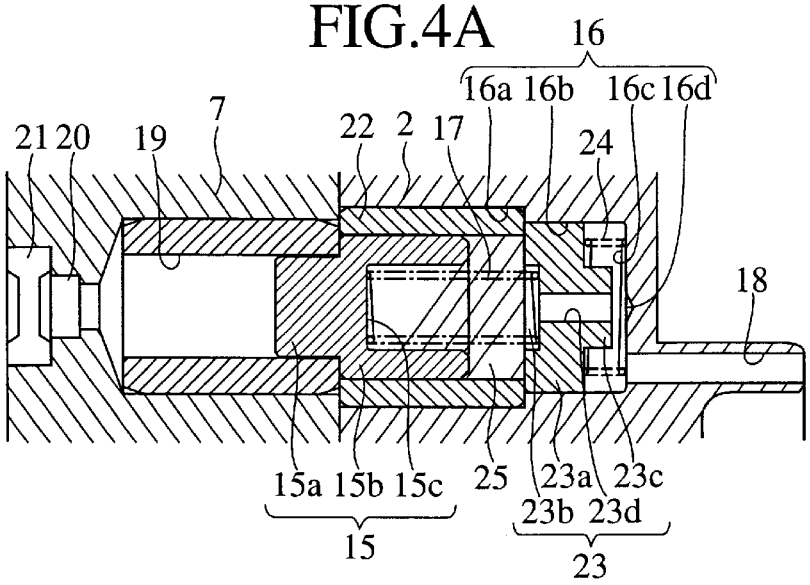
FIG. 4A to FIG. 4C are cross sectional views of variable throttle mechanism resulting from operation of a lock member in a valve timing control device as embodiment 1 according to the present invention.
Figure 4B:
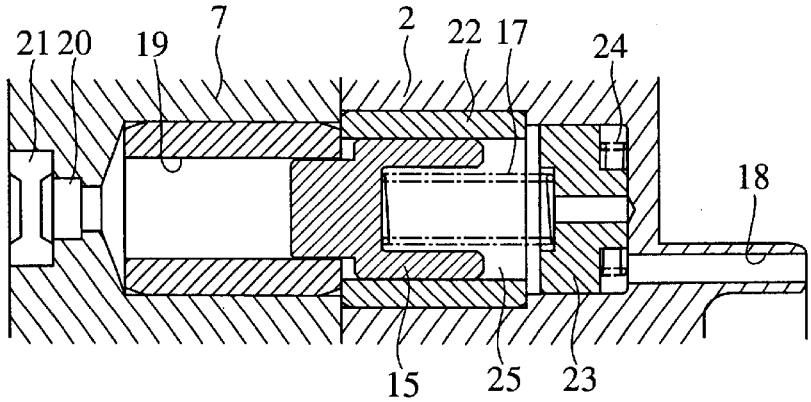
Figure 4C:
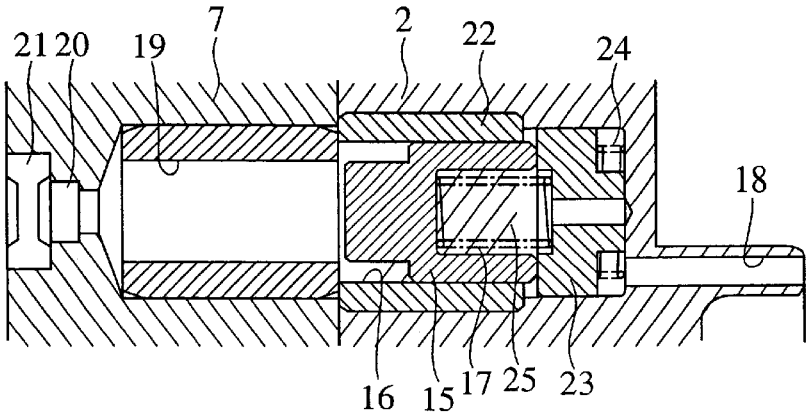

FIG. 4A to FIG. 4C are cross sectional views of variable throttle mechanism resulting from operation of a lock member in a valve timing control device as embodiment 1 according to the present invention. In the drawings since the common numerals denote common elements in the conventional structure of FIG. 1 to FIG. 3C, the description of such parts is omitted. Moreover, in the explanation of the first rotor, a side, close to the second rotor, of the first rotor is defined as a forward side, and the other side, away from the second rotor, of the first rotor is defined as a backward side. This definition is the same as the embodiments 2 and 3 will be explained hereafter.

The backward pressure chamber 16 in the embodiment 1 includes a major diameter section 16*a* formed at a front or shallow side in the chamber 16 and a minor diameter section 16*b* formed at a back or deep side in the chamber 16. A cylindrical holder 22 is press-fitted to the major diameter section 16*a*, the holder 22 having an inner diameter smaller than an inner diameter of the minor diameter section 16*b*. A sliding member (variable throttle mechanism) 23 is arranged in the minor diameter section 16*b* and forward operation of the sliding member 23 is restricted by the cylindrical holder 22. The sliding member 23 includes a major diameter section 23*a* sliding on an inner circumferential portion of the minor diameter section 16*b* of the backward pressure chamber 16, a concave portion 23*b* formed at a front end of the major diameter section 23*a* wherein the concave portion 23*b* has a bottom, a minor diameter section 23*c* formed at a rear section of the major diameter section 23*a*, and a perforation hole 23*d* formed coaxially in the minor diameter section 23*c* and the major diameter section 23*a* on the common axes of the minor diameter section 23*a* and the major diameter section 23*a*, the perforation hole 23*d* discharging a pressure defined between the lock pin 15 and the sliding member 23. A biasing member (variable throttle mechanism) 24 such as coil spring and so on is arranged between a rear end of the major diameter section 23*a* of the sliding member 23 and a rear wall face 16*c* of the backward pressure chamber 16 to bias forward the sliding member 23.

On the other hand, the lock pin 15 includes a minor diameter section 15*a* engaging with the engagement hole 19, a major diameter section 15*b* having a part sliding on the inner circumferential portion of the cylindrical holder 22 press-fitted to the backward pressure chamber 16 and a part subjected to a releasing hydraulic pressure, and a concave portion 15*c* formed at a rear end face of the major diameter section 15*b*. The biasing member 17 is arranged between both bottoms of the concave portion 15*c* of the lock pin 15 and the concave portion 23*b* of the sliding member 23.

A recess 16*d* subjected to the backward pressure is formed at a central portion of the rear wall face 16*c* of the backward pressure chamber 16. The discharge hole 18 is formed at a position of the rear wall face 16*c*, the position being apart from the sliding axes of the lock member 15 and the sliding member 23.

When the lock pin 15 is engaged with the engagement hole 19 to restrict the relative rotation of the first and second rotors, the front end face of the major diameter section 15*b* of the lock member 15 abuts with an end face of the rotor 7 acting as the second rotor. A biasing force of the biasing member 17 biasing the lock member 15 forward is defined as F1, and a biasing force of the biasing member 24 biasing the sliding member 23 forward is defined as F2. If equation of $F1 \leqq F2$ is established, a front end face of the sliding member 23 abuts with a rear end face of the cylindrical holder 22. In this case, it is preferable that F2 satisfies the equation and that F2 is nearly equal to F1. When spring constant of the biasing member 17 is defined as K1 and that of the biasing member 24 is defined as K2, equation of $K1 > K2$ must be established and K1 must be nearly equal to K2.

An assembly method of the periphery of the lock pin will be explained hereafter.

Firstly, the valve timing control device is laid. The sliding member 23 and the biasing member 24 are inserted into the minor diameter section 16*b* of the backward pressure chamber 16 and the cylindrical holder 22 is then press-fitted to the major diameter section 16*a* of the backward pressure chamber 16. The biasing member 17 and the lock pin 15 are inserted into the cylindrical holder 22 and thus the lock pin 15 is arranged slidably in the cylindrical holder 22. Next, the rotor 7 acting as the second rotor is mounted on the first rotor with a state that the lock pin 15 is pressed against the biasing force of the biasing member 17 within the backward pressure chamber 16.

A release operation due to the lock pin 15 will be explained hereafter.

Firstly, if a hydraulic pressure applied to the hydraulic pressure supply passage 20 reaches a required pressure by starting the oil pump (not shown), a hydraulic pressure subjected to the major diameter section 15*b* of the lock pin 15 is larger than the sum total of the biasing force of the biasing members 17 and 24. Thus, the lock pin 15 is returned in a direction of releasing the lock due to the lock pin 15. Depending on the settings of first load and the spring constant of the biasing member, the sliding member 23 is moved backward while the lock pin 15 is moved backward. Here, the stroke of the sliding member 23 is extremely shorter than that of the lock pin 15. With a locked state of, leaving the engagement of the minor diameter section 15*a* of the lock pin 15 with the engagement hole 19, a rear end face of the minor diameter section 23*c* of the sliding member 23 abuts with the rear wall face 16*c* of the backward pressure chamber 16. In this way, communication between a backward pressure space 25 defined between the lock pin 15 and the sliding member 23 and the discharge hole 18 is suppressed. Since the opening area of the discharge hole 18 substantially throttles, a speed of discharging the backward pressure is considerably delayed. In other words:, the air-mixing oil included in the backward pressure space 25 is discharged through a slight clearance between the rear end face of the minor diameter section 23*c* of the sliding member 23 and the rear wall face 16*c* of the backward pressure chamber 16 to the discharge hole 18. In this way, since the backward speed of the lock pin 15 can be delayed, the speed of releasing the lock can be also delayed.

A lock operation will be explained hereafter.

In the case that the lock pin 15 is engaged with the engagement hole 19, a hydraulic pressure of the hydraulic pressure supply passage 20 is reduced. A pressure difference between the vicinity of the front end face of the minor diameter section 15*a* of the lock pin 15 and the discharge hole 18 becomes therefore larger than a pressure difference between the vicinity of the front end face of the minor diameter section 15*a* of the lock pin 15 and the backward pressure space 25 positioned at the rear portion of the lock pin 15. The sliding member 23 is slid forward due to the biasing force of the biasing member 24, together with the lock pin 15 and thus the rear end face of the minor diameter section 23*c* of the sliding member 23 is separated from the rear wall face 16*c* of the backward pressure chamber 16. In this way, the discharge hole 18 communicates with the backward pressure space 25 through the perforation hole 23*d*. A pressure difference is newly occurred between the backward pressure space 25 and the vicinity of the front end face of the minor diameter section 15*a* of the lock member 15 and the lock pin 15 is thus separated from the sliding member 23 due to the biasing force of the biasing member 17 which results in the lock pin 15 sliding toward the engagement hole 19. In this case, a forward speed or engagement speed of the lock pin 15 is nearly equal to that of the lock pin 15 in the conventional valve timing control device shown in FIG. 1 to FIG. 3C because the backward pressure space 25 communicates with the discharge hole 18.

As described above, according to the embodiment 1, since the device is provided with the sliding member 23 acting as the variable throttle mechanism, the opening area of the discharge hole 18 formed in the backward pressure chamber 16 can be throttled on releasing the lock due to the lock member 15. The discharge speed of the backward pressure can delay considerably as compared with the conventional device and thus a backward speed of the lock member and a speed of releasing the lock can be also delayed. When hydraulic pressure increases on starting the engine, a release operation due to the lock pin 15 cannot be performed promptly. After the hydraulic pressure sufficient to control the valve timing control device is applied thereto, the lock pin 15 can be released and thus can prevent beat noise (abnormal noise) which occurs in the conventional example.

With the embodiment 1, the device is provided with the biasing member 24 biasing the sliding member 23 forward. In this way, since the sliding member 23, which throttles the opening area of the discharge hole 18 on locking due to the lock pin 15 until now, can be slid in a direction of controlling the opening area of the discharge hole 18 at the maximum, the engagement due to the lock pin 15 can be performed at the same speed as the conventional device.

Embodiment 2

Figure 5A:
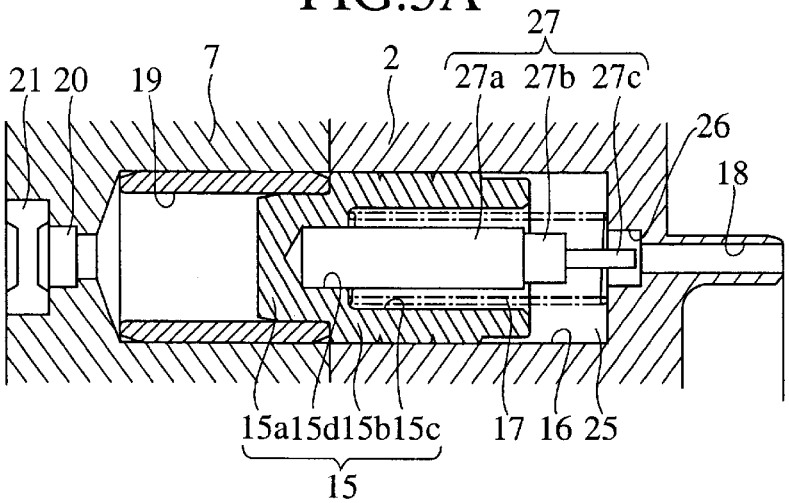
FIG. 5A to FIG. 5C are cross sectional views of variable throttle mechanism resulting from operation of a lock member in a valve timing control device as embodiment 2 according to the present invention.
Figure 5B:
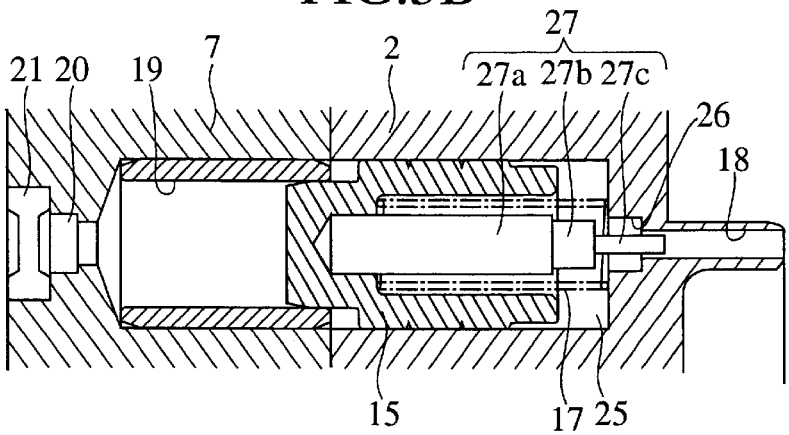
Figure 5C:
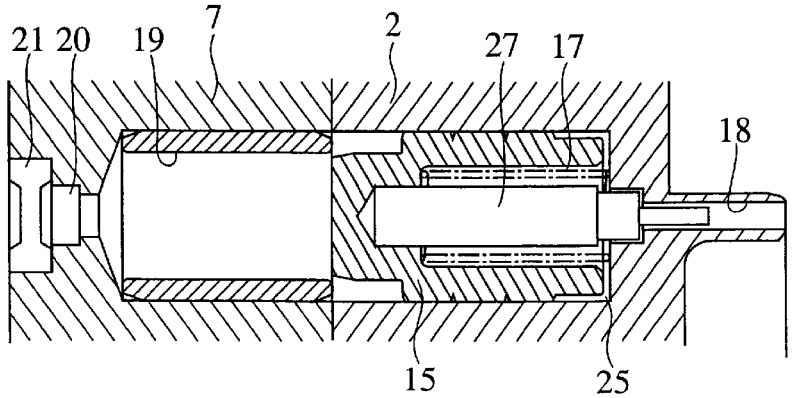

FIG. 5A to FIG. 5 are cross sectional views of variable throttle mechanism resulting from operation of a lock member in a valve timing control device as embodiment 2 according to in the present invention. In the drawings, since the common numerals denote common elements in the embodiment 1, the description of such parts is omitted.

The embodiment 2 is characterized in that a tier-providing opening 26 is arranged at a central portion of the rear wall face 16*c* of the backward pressure chamber 16 and that the discharge hole 18 is formed in the tier-providing opening 26 to be coaxial to the lock pin 15 and the backward pressure chamber 16. Moreover, the embodiment 2 is characterized in that a throttle rod (variable throttle mechanism) 27 having a cantilever shape is formed so as to extend from the bottom of the concave portion 15*c* of the lock pin 15 in a backward direction. The throttle rod 27 includes a major diameter section 27*a* arranged in the concave portion 15*c* of the lock pin 15, a middle diameter section 27*b* formed at a rear portion of the major diameter section 27*a* and inserted into the tier-providing opening 26, and a minor diameter section 27*c* formed at a rear portion of the middle diameter section 27*b* and inserted into the discharge hole 18.

The biasing member 17 is arranged between the concave portion 15*c* of the lock pin 15 and the rear wall face 16*c* of the backward pressure chamber 16 so as to wind around the throttle rod 27. The inner diameter of the biasing member 17 is larger than the outer diameter of the major diameter section 27*a* of the throttle rod 27 and the inner diameter of the tier-providing opening 26. The outer diameter of the biasing member 17 is smaller than the inner diameter of the concave portion 15*c* of the lock pin 15. Moreover, the inner diameter of the backward pressure chamber 16 is constant in a longitudinal direction (a sliding direction of the lock pin 15) as in the case of the backward pressure chamber 16 in the conventional valve timing control device shown in FIG. 1 to FIG. 3C. The backward pressure space 25 is defined between a rear portion of the lock pin 15 and the rear wall face 16*c* of the backward pressure chamber 16.

An assembly method of the periphery of the lock pin will be explained hereafter.

Firstly, a front end of the major diameter section 27*a* of the throttle rod 27 is press-fitted to a minor diameter section 15*d* of the concave portion 15*c* of the lock pin 15. The valve timing control device is then assembled. The biasing member 17 is inserted into a space between the concave portion 15*c* of the lock pin 15 and the throttle rod 27 so as to wind around the throttle rod 27. With this state, the lock pin 15 is inserted into the backward pressure chamber 16. Next, the rotor 7 acting as the second rotor is mounted on the first rotor with a state that the lock pin 15 is pressed against the biasing force of the biasing member 17 within the backward pressure chamber.

A release operation due to the lock pin 15 will be explained hereafter.

Firstly, if a hydraulic pressure applied to the hydraulic pressure supply passage 20 reaches a required pressure by starting the oil pump (not shown), a hydraulic pressure subjected to the major diameter section 15*b* of the lock pin 15 is larger than the biasing force of the biasing member 17. Thus, the lock pin 15 is returned in a direction of releasing the lock due to the lock pin 15. Here, when the lock pin 15 is slid backward, the minor diameter section 27*c* of the throttle rod 27 is inserted into the discharge hole 18 and thus the opening area of the discharge hole 18 is throttled. In this way, since the discharge speed of the backward pressure can delay considerably, the backward speed of the lock pin 15 can be also delayed. The speed of releasing the lock due to the lock pin 15 can be accordingly delayed by one-step as compared with the conventional device.

When the lock pin 15 is further moved backward, the middle diameter section 27*b* of the throttle rod 27 is inserted into the tier-providing opening 26. Here, difference between the opening area of the discharge hole 18 and the area in cross section of the minor diameter section 27*c* of the throttle rod 27 is defined as A1, and difference between the opening area of the tier-providing opening 26 and the area in cross section of the middle diameter section 27*b* of the throttle rod 27 is defined as A2. If an equation of A2 <A1 is established, the opening area of the discharge hole 18 can be further throttled. In this way, since the discharge speed of the backward pressure can further delay, the backward speed of the lock pin 15 can be also delayed. The speed of releasing the lock due to the lock pin 15 can be also delayed by two-steps as compared with the conventional device.

A lock operation will be explained hereafter.

In the case that the lock pin 15 is engaged with the engagement hole 19, a hydraulic pressure of the hydraulic pressure supply passage 20 is reduced and thus a pressure difference is occurred between a front end of the lock pin 15 and the discharge hole 18. The lock pin 15 is slid forward due to the biasing force of the biasing member 17 and it is possible to engage the minor diameter section 15*a* of the lock pin 15 with the engagement hole 19. Here, an initial engagement speed of the lock pin 15 slows as compared with the conventional device because the opening area of the discharge hole 18 is throttled by the insertion of the minor diameter section 27*c* of the throttle rod 27 into the discharge hole 18. However, since the opening area of the discharge hole 18 is increased rapidly as the lock pin 15 can be accelerated to high velocities forward, the engagement speed of the lock pin 15 can be also accelerated.

As shown above, according to the embodiment 2, the throttle rod 27 acting as the variable throttle mechanism is integrated with the lock pin 15. In this way, the engagement speed of the lock pin 15 gets slower than that of the embodiment 1 in some degree. Since the number of parts of the device can be however reduced, it is possible to reduce manufacturing costs and facilitate assembly.

With the embodiment 2, the device is provided with one of the tier-providing opening 26 with respect to the discharge hole 18 to close them with the minor diameter section 27*c* and the middle diameter section 27*b* of the throttle rod 27. Alternatively, the device may be provided with a plurality of the tier-providing opening 26 with respect to the discharge hole 18 to close them with a plurality of sites, which correspond to them, of the throttle rod 27. In this case, the speed of releasing the lock can be delayed in a plurality of steps of more than three steps.

Embodiment 3

Figure 6A:
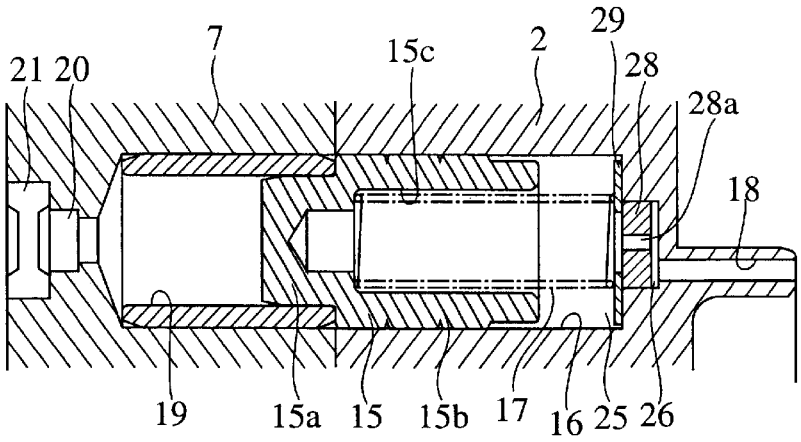
FIG. 6A to FIG. 6C are cross sectional views of variable throttle mechanism resulting from operation of a lock member in a valve timing control device as embodiment 3 according to the present invention.
Figure 6B:
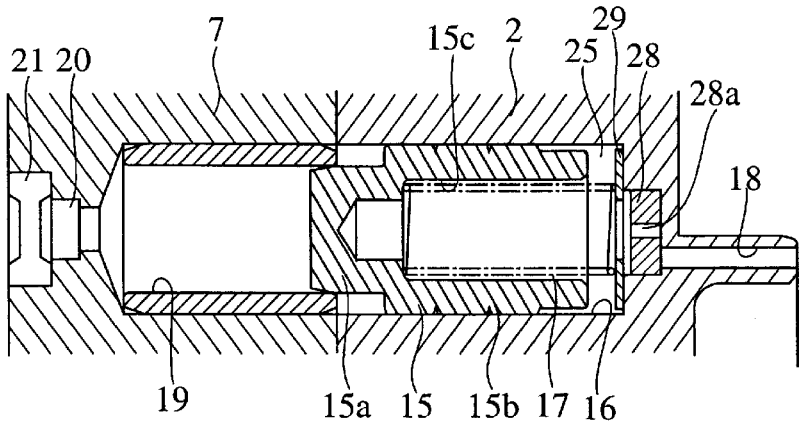
Figure 6C:
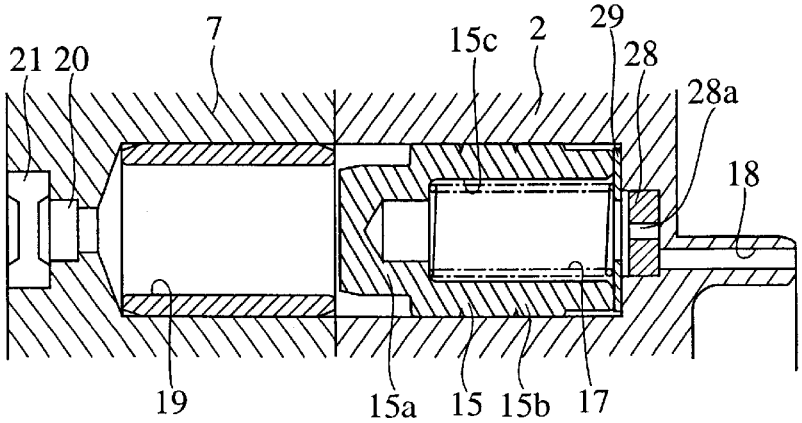

FIG. 6A to FIG. 6C are cross sectional views of variable throttle mechanism resulting from operation of a lock member in a valve timing control device as embodiment 3 according to the present invention. In the drawings, since the common numerals denote common elements in the embodiment 1 and so on, the description of such parts is omitted.

The embodiment 3 is characterized in that the discharge hole 18 is arranged at a position apart from the central axis of the backward pressure chamber 16 and that a cylindrical sliding member 28 is arranged within the tier-providing opening 26. The sliding member 28 has a perforation hole 28*a* formed at the central portion thereof without directly communicating with the discharge hole 18. A length of the sliding member 28 in the sliding direction is set to be shorter than a length of the tier-providing opening 26 in the same direction. A toroidal plate 29 is arranged at the rear wall face 16*c* of the backward pressure chamber 16. The inner diameter of a central hole 29*a* of the toroidal plate 29 is set to be larger than the inner diameter of the perforation hole 28*a*. The inner diameter of the backward pressure chamber 16 is constant in a longitudinal direction (a sliding direction of the lock pin 15) as in the case of the backward pressure chamber 16 in the embodiment 2. The biasing member 17 is arranged in a space between the plate 29, which is arranged at the rear wall face 16*c* of the backward pressure chamber 16, and a bottom of the concave portion 15*c* of the lock pin 15.

A release operation due to the lock pin 15 will be explained hereafter.

Firstly, if a hydraulic pressure applied to the hydraulic pressure supply passage 20 reaches a required pressure by starting the oil pump (not shown), a hydraulic pressure subjected to the major diameter section 15*b* of the lock pin 15 is larger than the biasing force of the biasing member 17. Thus, the lock pin 15 is returned in a direction of releasing the lock due to the lock pin 15. Here, when the lock pin 15 is slid backward, a pressure of the backward pressure space 25 is discharged from the discharge hole 18 through the perforation hole 28*a* of the sliding member 28 and the tier-providing opening 26. When the discharge speed of the backward pressure space 25 is sufficiently larger than the discharge speed of the perforation hole 28*a* of the sliding member 28, the sliding member 28 is slid while closing to a rear wall face in the tier-providing opening 26. In this way, the discharge hole 18 can be closed with a rear end of the sliding member 28 and thus the discharge speed of the backward pressure can delay considerably. In other words, when a hydraulic pressure rises rapidly on starting the engine, the release operation can be delayed.

A lock operation will be explained hereafter.

In the case that the lock pin 15 is engaged with the engagement hole 19, a hydraulic pressure of the hydraulic pressure supply passage 20 is reduced. A pressure difference between the vicinity of the front end of the minor diameter section 15*a* of the lock pin 15 and the discharge hole 18 is larger than a pressure difference between the vicinity of the front end of the minor diameter section 15*a* of the lock pin 15 and the backward pressure space 25 positioned at the rear portion of the lock pin 15. Therefore, the sliding member 28 is slid forward together with the lock pin 15 and thus the rear end face of the sliding member 28 is apart from the rear end face of the tier-providing opening 26. Since the discharge hole 18 communicates with the backward pressure space 25 through the perforation hole 28*a*, the minor diameter section 15*a* of the lock pin 15 is engaged with the engagement hole 19. Here, since the discharge hole 18 communicates with the backward pressure space 25, the engagement due to the -lock pin 15 can be performed at the same speed as the conventional device.

As described above, according to the embodiment 3, since the device is provided with the sliding member 28, the discharge speed of the backward pressure can delay considerably as compared with the conventional device similar to the embodiment 1. In this way, the backward speed of the lock member and the speed of releasing the lock can be also delayed. With a state of rising a hydraulic pressure on starting the engine, a release operation due to the lock pin 15 cannot be performed promptly. After the hydraulic pressure sufficient to control the valve timing control device is applied thereto, the lock pin 15 can be released and thus can prevent beat noise (abnormal noise) occurred conventionally.

With the embodiment 3, the release operation can be performed only when an inrush speed due to the release hydraulic pressure of the embodiment 3 is higher than that of the embodiment 1. In this case, it is also possible to constitute cheaply the device and to assemble easily the device.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device, comprising:

a first rotor rotating in synchronization with a crankshaft of an internal combustion engine;

a second rotor fixed on an end of an intake camshaft or an exhaust camshaft of the internal combustion engine and rotatably arranged in the first rotor;

a lock member locking the first and second rotors at a required angle which any one of the rotors forms with the other;

a backward pressure chamber arranged at any one of the first and second rotors, the backward pressure chamber allowing accommodation of the lock member and a biasing member biasing the lock member and having a discharge hole for discharging the backward of the lock member to the outside;

an engagement hole arranged at the other rotor, the engagement hole allowing insertion of the lock member and having a hydraulic pressure supply passage for supplying a hydraulic pressure used for releasing lock due to the lock member; and a variable throttle mechanism arranged in the backward pressure chamber, the variable throttle mechanism throttling an opening area of the discharge hole in the backward pressure chamber on releasing the lock due to the lock member and controlling the opening area of the discharge hole at the maximum on locking due to the lock member.

2. A valve timing control device according to claim 1, wherein the variable throttle mechanism includes a sliding member having a perforation hole formed inside thereof, the sliding member reducing the discharge hole on releasing the lock due to the lock member and opening the discharge hole on locking due to the lock member.

3. A valve timing control device according to claim 2, wherein the sliding member slides in parallel with the sliding axis of the lock member to reduce the discharge hole on releasing the lock due to the lock member and slides in parallel with the sliding axis of the lock member to open the discharge hole on locking due to the lock member.

4. A valve timing control device according to claim 2, wherein the variable throttle mechanism reduces the discharge hole continuously and variably.

5. A valve timing control device according to claim 3, wherein the sliding member reduces the discharge hole continuously and variably.

6. A valve timing control device according to claim 1, wherein the variable throttle mechanism has a biasing member for biasing the variable throttle mechanism in a direction of opening the discharge hole on locking the lock due to the lock member.

7. A valve timing control device according to claim 2, wherein the variable throttle mechanism has a biasing member for biasing the sliding member in a direction of opening the discharge hole on locking the lock due to the lock member.

8. A valve timing control device according to claim 3, wherein the variable throttle mechanism has a biasing member for biasing the sliding member in a direction of opening the discharge hole on locking the lock due to the lock member.

9. A valve timing control device according to claim 4, wherein the variable throttle mechanism has a biasing member for biasing the sliding member in a direction of opening the discharge hole on locking the lock due to the lock member.

10. A valve timing control device according to claim 5, wherein the variable throttle mechanism has a biasing member for biasing the sliding member in a direction of opening the discharge hole on locking the lock due to the lock member.

11. A valve timing control device according to claim 1, wherein the variable throttle mechanism includes a throttle rod integrated with the lock member, the throttle rod reducing the discharge hole on releasing the lock due to the lock member and opening the discharge hole on locking due to the lock member.

12. A valve timing control device according to claim 11, wherein the throttle rod slides coaxially on the sliding axis of the lock member to reduce the discharge hole on releasing the lock due to the lock member and slides coaxially on the sliding axis of the lock member to open the discharge hole on locking due to the lock member.

13. A valve timing control device according to claim 11, wherein the variable throttle mechanism reduces the discharge hole in a stepwise manner.

14. A valve timing control device according to claim 12, wherein the variable throttle mechanism reduces the discharge hole in a stepwise manner.

* * * * *